United States Patent [19]

Liebrandt et al.

[11] 4,018,065

[45] Apr. 19, 1977

[54] DRIVING APPARATUS FOR THE KNITTING IMPLEMENT BARS OF WARP KNITTING MACHINES

[76] Inventors: Gunnar Liebrandt, Pitschhausenweg 1a, Naila (8674); Adolf Hägel, Hauptstrasse 68, Bobengrun (8671); Gerhard Gallwitz, Neulandstrasse 8, Naila (8674), all of Germany

[22] Filed: Feb. 19, 1976

[21] Appl. No.: 659,354

[52] U.S. Cl. ..... 66/208

[51] Int. Cl.[2] ..... D04B 23/00

[58] Field of Search ..... 66/86 F, 86 R, 86 B

[56] References Cited

UNITED STATES PATENTS

| | | | |
|---|---|---|---|
| 2,700,285 | 1/1955 | Belli | 66/86 F |
| 3,688,524 | 9/1972 | Peschl et al. | 66/86 F |
| 3,802,226 | 4/1974 | Kohl | 66/86 B |
| 3,890,807 | 6/1975 | Socha et al. | 66/86 R |

*Primary Examiner*—Ronald Feldbaum
*Attorney, Agent, or Firm*—Kenneth S. Goldfarb

[57] ABSTRACT

A driving apparatus for knitting implement bars of warp knitting machines, comprising a main shaft and several individually driven cam or crank discs each mounted on a separately supported axle. This arrangement permits a substantial reduction of size and weight of the driving mechanism as compared with usual drives consisting of a single shaft bearing the cam or crank discs.

2 Claims, 4 Drawing Figures

DRIVING APPARATUS FOR THE KNITTING IMPLEMENT BARS OF WARP KNITTING MACHINES

In the art of knitting machines, it is usual to provide either cam disc drives or crank drives with jointed cranks for actuating the bars carrying the knitting implements. The cam discs used for cam drives are mounted in the main shaft. For crank drives, excenter discs are arranged on one or more shafts; these excenter discs or disc cranks, when driven with constant speed, generate the movements characteristic for the operation of the knitting elements. For the various movements of the knitting elements, numerous differently designed cam discs or crank drives are disposed over the width of the machine. The shafts bearing the cam or crank discs and having a length of up to 7.5 meters on wide machines, must be designed with sufficient diameter to give them high bending and tensional strength. This leads to relatively large diameters of the shaft bearing the cam or crank discs which in turn causes corresponding sizes and weights of the cam or crank discs and the associated connecting rods. Cam or crank discs with connecting rods and the shaft bearing them constitute a considerable mass, and the gravity centers of the discs with connecting rods, according to the various knitting movements, are unevenly distributed over the full cycle of 360°.

The masses of cam or crank discs with associated connecting rods, considering the unevenly distributed gravity centers, are likely to cause unwanted and harmful vibrations which cannot fully be compensated by counterweights. Besides, such counterweights additionally increase the total mass to be moved.

It is, therefore, an object of the present invention to reduce the total mass of the driving elements and to prevent unwanted and detrimental vibrations caused by the driving elements of knitting machines.

According to the invention, in a knitting machine with a main shaft there are provided several axles, each with a separate bearing arrangement and independently driven by the main shaft. Each axle is equipped with a cam or crank disc for actuating the knitting elements. Due to this individual arrangement and support of relatively short axles for cam or crank discs, the diameter of the main shaft and the dimensions or the cam or crank discs and the associated connecting ords can be substantially reduced. This avoids unwanted, harmful vibrations and procures the essential requirements for an increase of the operating speed of knitting machines.

According to an additional feature of the invention, each axle with the associated cam or crank disc and the other linkage necessary may constitute a unit. This unit may be the essential part of a pre-mounted gearing set.

Figure 1:
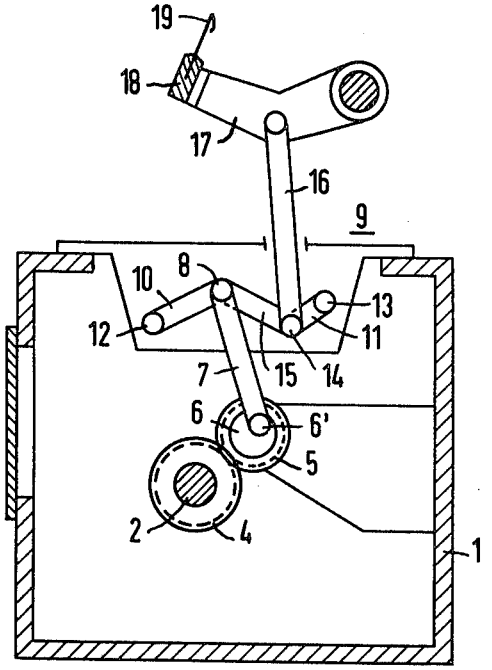
Figure 2:
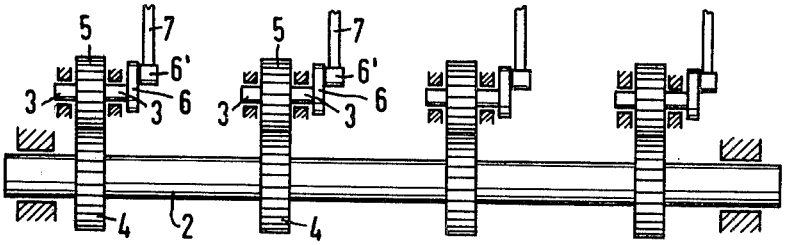
Figure 3:
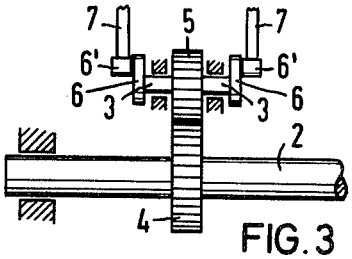
Figure 4:
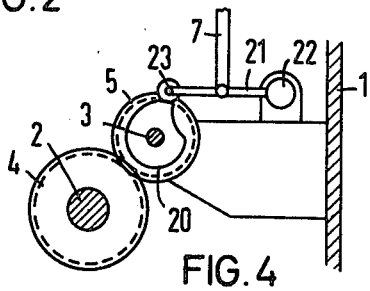

Further objects and features of the invention will become apparent from the following description of embodiments schematically illustrated in the annexed drawing, in which FIG. 1 is a lateral view, partly in section, of a gearing for driving the needle bar of a warp knitting machine, FIG. 2 is a front view of the main or countershaft, partially showing the various individual drives, FIG. 3 is a further front view of a portion of the main shaft with parts of a modifies transmission gearing, FIG. 4 is a partial view of another drive using cam discs instead of cranks.

The gearing shown in FIG. 1 comprises a gear box 1 filled with oil. The countershaft 2, extending over the entire width of the machine (not shown), is supported at both ends in said gear box. The countershaft 2 constitutes the main driving shaft of the machine.

Above the main shaft 2, there are arranged four individual and separately supported axles 3 driven by means of gear 4 and 5 from the main shaft. As can be seen in FIG. 2, each axle 3 bears, on its right side, a crank disc 6 with a crank pin 6'. A connecting rod 7 is journalled at the crank pin 6' and actuates the joint 8 of an associated linkage 9. One of these linkages is shown in FIG. 1. It is to be understood that the other crank drives act on different linkages and consequently move different knitting implement bars.

The linkage consists of two oscillating levers 10 and 11 supported by bearings 12 and 13 mounted in the machine frame. The lever 11 is connected at 14 with a link 15 ending at the joint 8. At 14, a connecting rod 16 is journalled to the lever 11 and transmits the movement of the linkage 9 to the swinging lever 17, thus producing the desired motions of the needle bar 18 with the knitting needles 19.

The axle 3 with associated crank disc 6, crank pin 6' and linkage 9 may constitute a unit which can be completely mounted prior to installation in the machine and is easy to replace.

FIG. 3 shows an embodiment comprising an axle 3 which is provided with crank discs 6 and crank pinks 6' on both sides, actuating two connecting rods 7.

FIG. 4 is a modification of FIG. 1 showing schematically the use of cam discs 20 instead of cranks. A lever 21 is supported at 22 and has on its other end a roller 23 running on the cam. The connecting rod 7 is actuated according to the shape of the cam.

It will be apparent to anybody skilled in the art that what is specifically shown and described may be modified and changed without departing from spirit and scope of the invention.

What is claimed is:

1. Driving apparatus for the knitting implement bars of warp knitting machines, comprising a main shaft, a plurality of individual axles each with a separate bearing arrangement and independent driving connection with said main shaft, each of said axles being provided with at least one eccentric means for generating the desired motions of said bars, and a plurality of linkages each acting on a knitting implement bar and being driven independently from the others by an associated eccentric means.

2. Driving apparatus as claimed in claim 1, each axle with coordinated linkage constituting a completely mounted unit for installation and replacement.

* * * * *